US006374804B1

(12) United States Patent
Vattelana

(10) Patent No.: US 6,374,804 B1
(45) Date of Patent: Apr. 23, 2002

(54) EXTRUDED FUEL RAIL AND BRACKET COMBINATION

(75) Inventor: Gary Douglas Vattelana, Prince George, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/606,230

(22) Filed: Jun. 29, 2000

(51) Int. Cl.[7] ..... F02N 41/00
(52) U.S. Cl. ..... 123/456; 123/195 A
(58) Field of Search ..... 123/456, 468, 123/469, 470, 195 A

(56) References Cited

U.S. PATENT DOCUMENTS 4,510,909 A 4/1985 Elphick et al.
4,539,961 A 9/1985 Atkins et al.
4,570,602 A 2/1986 Atkins et al.
5,080,069 A * 1/1992 Hudson, Jr. ..... 123/456
5,197,435 A * 3/1993 Mazur et al. ..... 123/456
5,333,587 A * 8/1994 DiSilvestro et al. ..... 123/456
5,408,971 A 4/1995 Jaeger et al.
5,445,130 A 8/1995 Brümmer et al.
5,513,613 A 5/1996 Taylor et al.
5,682,857 A * 11/1997 Briggs et al. ..... 123/456
5,735,247 A * 4/1998 Tsuzuki et al. ..... 123/470

* cited by examiner

*Primary Examiner*—Willis R. Wolfe
*Assistant Examiner*—Mahmoud Gimie

(57) ABSTRACT

A fuel rail assembly is disclosed. The fuel rail assembly includes a fuel rail and a bracket. The fuel rail has a body extending along a longitudinal axis, a first face extending along the body, and a second face extending along the body and juxtaposed from the first face. The fuel rail also includes a channel extending through the body along the longitudinal axis and at least one opening extending into the body from the first face toward the second face. The bracket includes a first end disposed within the opening and fixedly connected to the fuel rail and a second end extending from the fuel rail. The second end includes a mounting portion. A method of manufacturing the fuel rail assembly is also disclosed.

19 Claims, 5 Drawing Sheets

EXTRUDED FUEL RAIL AND BRACKET COMBINATION

FIELD OF THE INVENTION

The present invention relates to an improved fuel rail and a method of manufacturing the same.

BACKGROUND OF THE INVENTION

In known extruded fuel rails, integrated manifold mounts were used to mount the fuel rail to an engine manifold. As a result of the extrusion process, the manifold mount extended the length of the fuel rail. After extrusion, excess material from the manifold mount was removed from the extrusion. The excess material was removed to reduce weight, to allow room for or to avoid other engine components, and/or for general cosmetic appearances. The excess material was typically removed by shearing or machining processes. The processes add additional steps to the manufacturing process, resulting in additional time and cost to manufacture the fuel rail. Further, the previous one-piece extruded field rail was usable only for a particular design application, and would require expensive redesign and retooling to produce a fuel rail with a different bracket profile, if desired for a different application.

It would be beneficial to develop an extruded fuel rail and bracket combination that is quick and easy to manufacture, and also allow modification to the bracket to fit different applications.

BRIEF SUMMARY OF THE INVENTION

Briefly, the present invention provides a fuel rail assembly comprising a fuel rail and a bracket. The fuel rail has a body extending along a longitudinal axis, a first face extending along the body, and a second face extending along the body and juxtaposed from the first face. The fuel rail also has a channel extending through the body along the longitudinal axis and at least one opening extending into the body from the first face toward the second face. The bracket includes a first end disposed within the opening and fixedly connected to the fuel rail and a second end extending from the fuel rail. The second end includes a mounting portion.

The present invention also provides a method of fabricating a fuel rail assembly. The method comprises extruding a fuel rail having a channel extending therethrough. The method also comprises forming an opening in the fuel rail, generally perpendicular to and distal from the channel. The method further comprises inserting a bracket into the opening; and fixedly connecting the bracket to the fuel rail.

BRIEF DESCRIPTION OF THE DRAWINGS

The accompanying drawings, which are incorporated herein, and constitute part of this specification, illustrate the presently preferred embodiments of the invention, and, together with the general description given above and the detailed description given below, serve to explain the features of the invention. In the drawings.

DETAILED DESCRIPTION OF THE PREFERRED EMBODIMENTS

Figure 1:
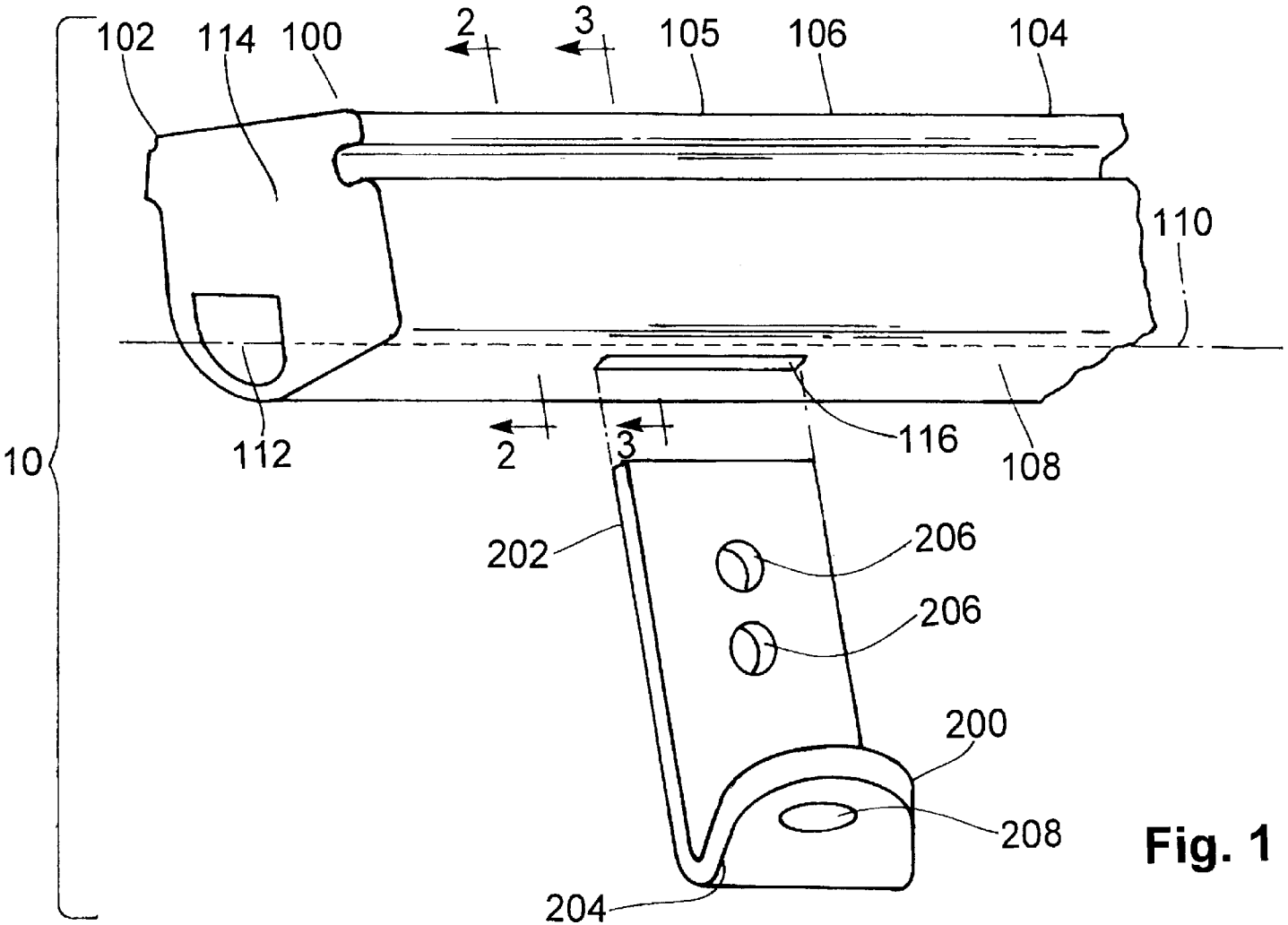
FIG. 1 is an exploded perspective view of an extruded fuel rail and bracket combination in accordance with a preferred embodiment of the present invention.

FIG. 1 shows an exploded perspective view of a fuel rail assembly 10 according to a first preferred embodiment of the present invention. As used herein, like numbers indicate like components throughout. The fuel rail assembly 10 includes a fuel rail 100 and a bracket 200.

The fuel rail 100 includes a first end 102, and a second end 104, juxtaposed from the first end 102. The fuel rail also includes a body 105 having a first, or top face 106 and a second, or bottom face 108, juxtaposed from and generally parallel to the top face 106. The top and bottom faces 106, 108, respectively, extend along the body 105. The fuel rail 100 also includes a longitudinal axis 110 extending therethrough, generally parallel to each of the top face 106 and the bottom face 108. A longitudinal channel 112 extends through the body 105, between the first and second ends 102, 104, along the longitudinal axis 110. Preferably, the fuel rail 100 and the channel 112 are formed by extrusion, although those skilled in the art will recognize that the fuel rail 100 and the channel 112 can be formed by other methods.

Figure 3:
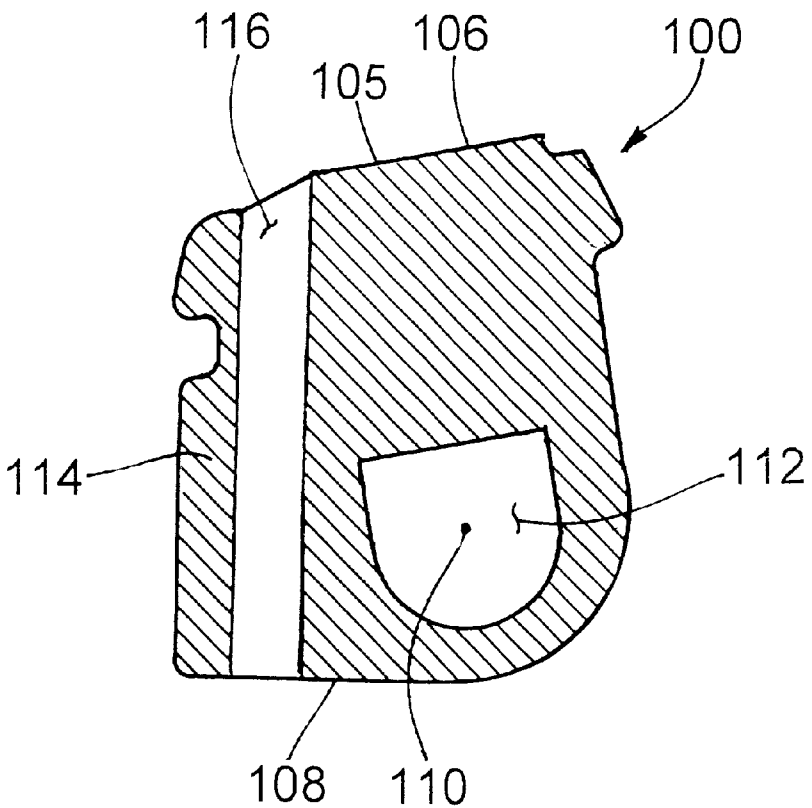
FIG. 3 is a sectional view of the extruded fuel rail taken along line 3—3 in FIG. 1.
Figure 2:
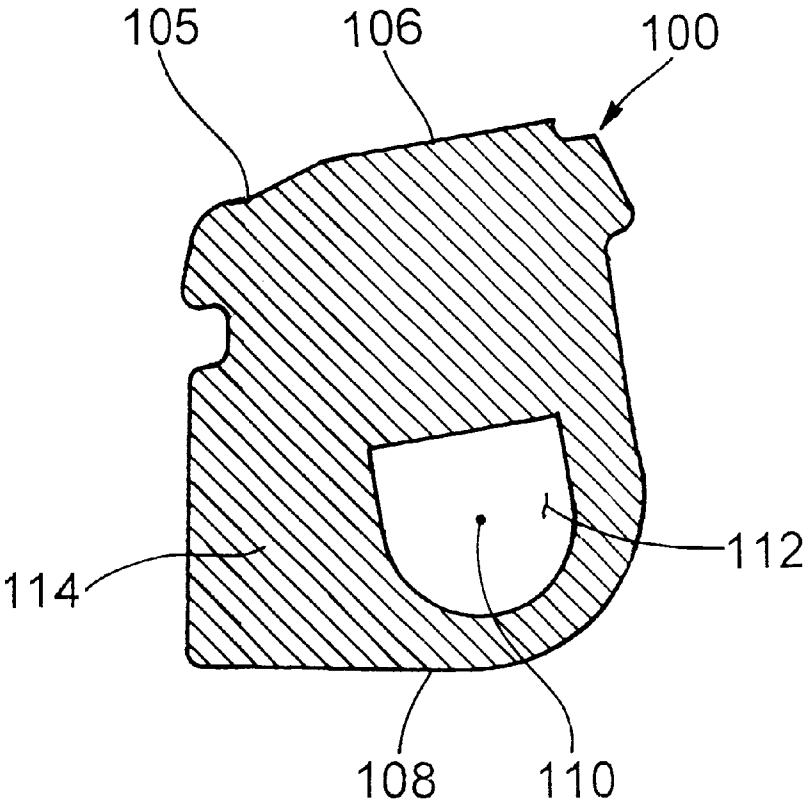
FIG. 2 is a sectional view of the extruded fuel rail taken along line 2—2 in FIG. 1.

As shown in FIG. 2, the fuel rail 100 includes a solid portion 114 which extends alongside the channel 112 from the first end 102 to the second end 104. As shown in FIG. 3, at least one opening 116 which extends into the body 105 from the bottom face 108 to the top face 106 is formed in the solid portion 114 at predetermined locations along the length of the fuel rail 100. Preferably, the opening 116 is generally perpendicular to and distal from the channel 112. Also preferably, the opening 116 is a machined slot, although those skilled in the art will recognize that the opening 116 can be formed by other than machining, and can be shaped other than as a slot. Additionally, those skilled in the art will also recognize that the opening 116 need not extend all the way to the top face 106, but may end inside the body 105.

Preferably, the fuel rail 100 is manufactured from stainless steel, although those skilled in the art will recognize that the fuel rail 100 can be formed from other materials which do not react with field.

Referring back to FIG. 1, the bracket 200 includes a first end 202 and a second end 204. The first end 202 of the bracket 200 is sized to fit into the opening 116 in the field rail 100. The first end 202 is located in a first plane and the second end 204 is located in a second plane. As shown in FIG. 1, the first plane is the plane of the paper, and the second plane extends from the plane of the paper. However, those skilled in the art will recognize that the first and second ends 202, 204 can be located in other planes as well.

The first end 202 includes at least one, and preferably more than one, securing opening 206 is located in the first end 202. The securing openings 206 are used to help secure the bracket 200 to the fuel rail 100, as will be described in more detail later herein. The second end 204 preferably includes an opening 208 extending therethrough to secure the bracket 200 to an engine or other component (not shown). Preferably, the bracket 200 is preferably manufactured from carbon steel. The bracket 200 need not necessarily be manufactured from a material which does not react with fuel, as the bracket 200 does not contact any fuel. As such, the fuel rail 100 and the bracket 200 can be manufactured from two different materials.

Figure 4:
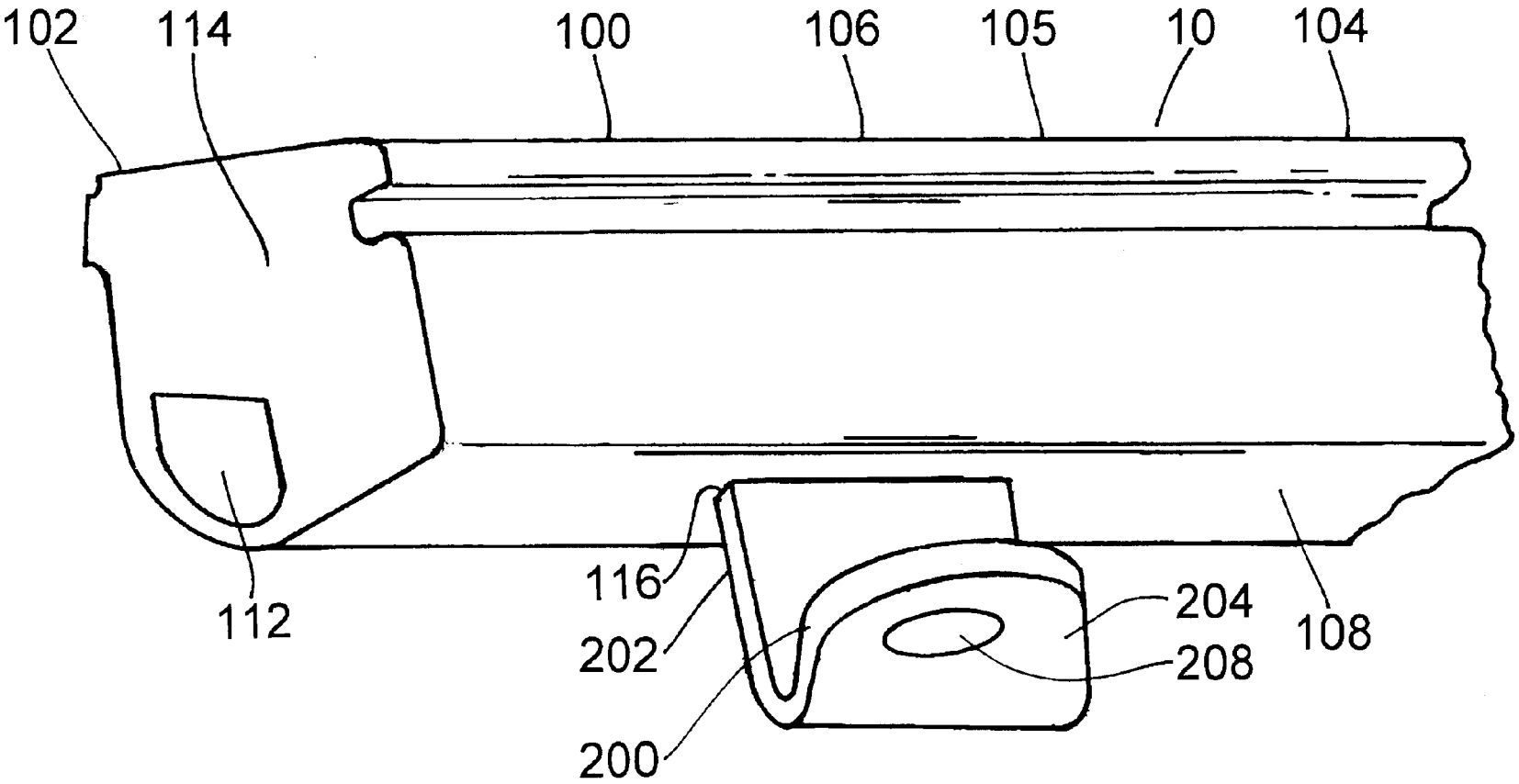
FIG. 4 is a perspective view of the extruded fuel rail and bracket combination with the bracket inserted into the fuel rail.

As shown in FIG. 4, the first end 202 of the bracket 200 is inserted into the opening 116 in the fuel rail 100, preferably from the bottom face 108 toward the top face 106. However, those skilled in the art will recognize that the bracket 200 can be inserted into the fuel rail 100 from the top face 106 toward the bottom face 108.

Figure 5:
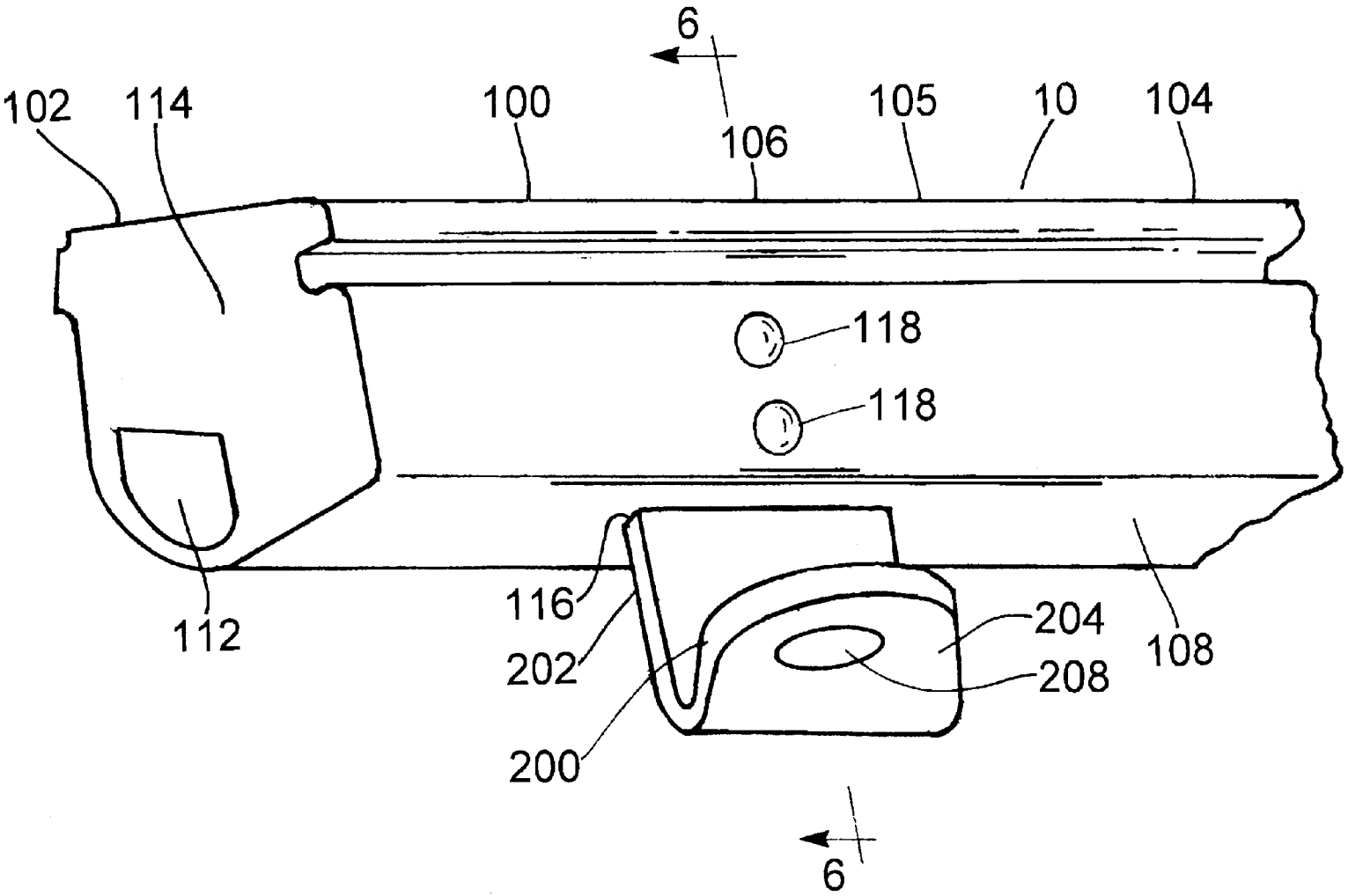
FIG. 5 is a perspective view of the extruded fuel rail and bracket combination with the bracket fixedly connected to the fuel rail.
Figure 6:
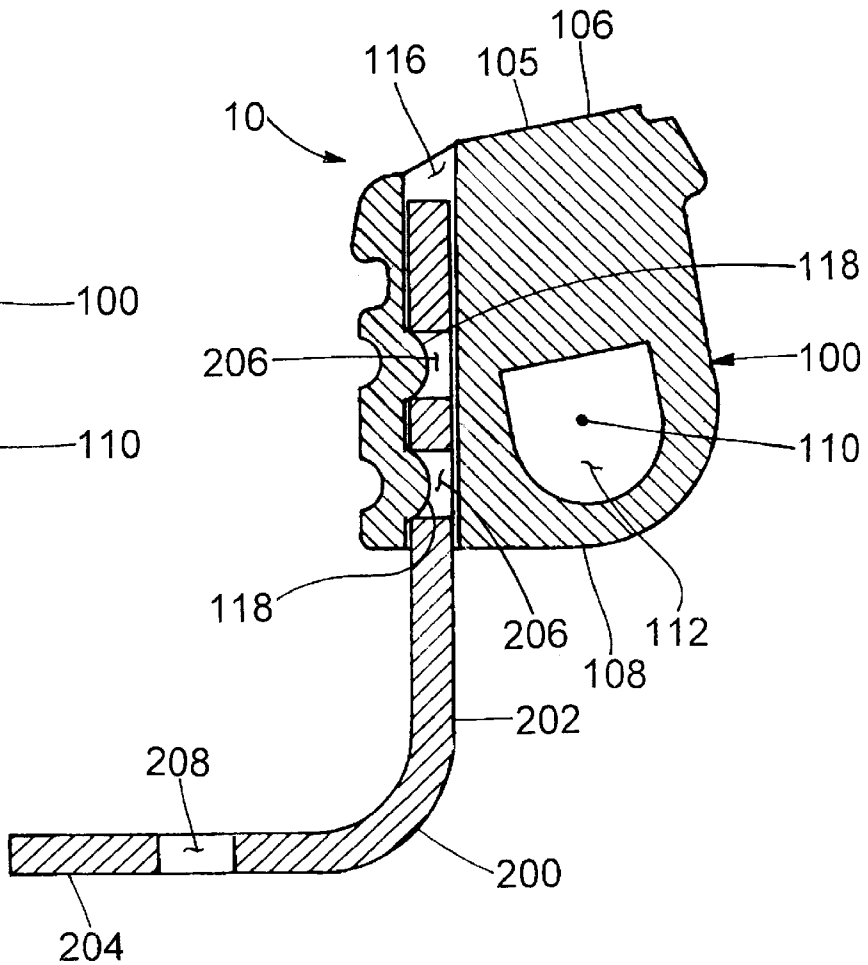
FIG. 6 is a sectional view of the fuel rail and bracket combination taken along line 6—6 in FIG. 5.

As shown in FIG. 5, the bracket 200 is fixedly connected to the fuel rail 100 by peening a portion of the fuel rail 100 into the securing openings 206 in the first end 202 of the bracket 200. As a result of the peening process, nubs 118 from the fuel rail 100 are forced into the securing openings 206. By peening the fuel rail 100 into the two securing openings 206 as shown in FIG. 5, the fuel rail 100 cannot pivot about the securing openings 206, resulting in the fuel rail 100 being fixedly connected to the bracket 200. FIG. 6 shows a sectional view of the bracket 200 having been peened into the securing openings 206.

Figure 7:
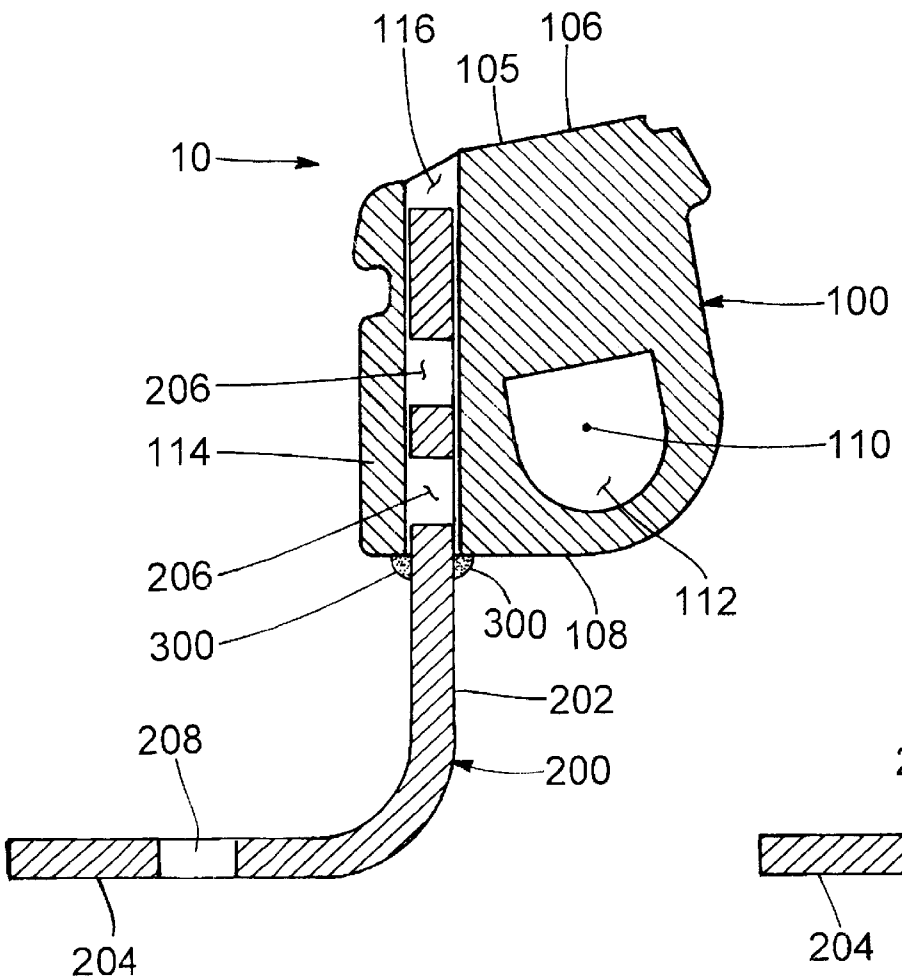
FIG. 7 is a sectional view of the fuel rail and bracket combination according to a second preferred embodiment of the present invention.

Although the bracket 200 is preferably secured to the fuel rail 100 by means of peening, those skilled in the art will recognize that other methods of securing the bracket 200 to the fuel rail 100 can be used. As shown in FIG. 7, the bracket 200 can be secured to the fuel rail 100 by means of at least one weld, and preferably two welds, 300.

It will be appreciated by those skilled in the art that changes could be made to the embodiments described above without departing from the broad inventive concept thereof It is understood, therefore, that this invention is not limited to the particular embodiments disclosed, but it is intended to cover modifications within the spirit and scope of the present invention as defined in the appended claims.

What is claimed is:

1. A fuel rail assembly comprising:

a fuel rail having:

a body extending along a longitudinal axis;

a first face extending along the body, a second face extending along the body and juxtaposed from the first face;

a channel extending through the body along the longitudinal axis; and at least one opening extending into the body from the first face toward the second face; and a bracket including:

a first end disposed within the opening and fixedly connected to the fuel rail; and a second end extending from the fuel rail, the second end including a mounting portion.

2. The fuel rail assembly according to claim 1, wherein the at least one opening extends through the body between the first face and the second face.

3. The fuel rail assembly according to claim 1, wherein the at least one opening is generally transverse to the longitudinal axis.

4. The fuel rail assembly according to claim 1, wherein the second end of the bracket comprises a through hole extending therethrough.

5. The fuel rail assembly according to claim 1, wherein the at least one opening is a slot.

6. The fuel rail assembly according to claim 1, wherein the fuel rail comprises a first material and the bracket comprises a second material.

7. The fuel rail assembly according to claim 6, wherein the first material is different from the second material.

8. The fuel rail assembly according to claim 1, wherein the fuel rail is connected to the bracket by welding.

9. The fuel rail assembly according to claim 1, wherein the first end of the bracket includes at least one peening hole and wherein the fuel rail is peened into the at least one peening hole.

10. The fuel rail assembly according to claim 1, wherein the first end of the bracket is in a first plane and the second end of the bracket is in a second plane.

11. The fuel rail assembly according to claim 10, wherein the first plane intersects the second plane.

12. The fuel rail assembly according to claim 1, wherein the fuel rail is extruded.

13. The fuel rail assembly according to claim 12, wherein the channel in the fuel rail is formed by extrusion.

14. The fuel rail assembly according to claim 12, wherein the opening is formed by machining.

15. A method of fabricating a fuel rail assembly comprising:

extruding a fuel rail having a channel extending therethrough;

forming an opening in the fuel rail, generally perpendicular to and distal from the channel;

inserting a bracket into the opening; and fixedly connecting the bracket to the fuel rail.

16. The method according to claim 15, wherein fixedly connecting the bracket to the fuel rail comprises peening.

17. The method according to claim 15, wherein fixedly connecting the bracket to the fuel rail comprises welding.

18. The method according to claim 15, wherein forming the opening comprises machining the opening.

19. A fuel rail assembly comprising:

a fuel rail, the fuel rail having a body extending along a longitudinal axis, the body including a channel being formed by extrusion, and at least one opening extending into the body in a direction transverse to the longitudinal axis, the at least one opening having one of a plurality of nubs and securing openings; and at least one bracket, the at least one bracket having a first end and a second end, the first end being disposed in the at least one opening, the first end having the other of the plurality of nubs and securing openings, the second end including a mounting portion.

* * * * *